US007478456B2

(12) United States Patent
Barker et al.

(10) Patent No.: US 7,478,456 B2
(45) Date of Patent: Jan. 20, 2009

(54) MOUNTING DEVICE FOR VACUUM CLEANER ACCESSORY

(75) Inventors: David Barker, Prudhoe (GB); Barry Pears, Langley Moor (GB); Martyn Riley, Jesmond (GB)

(73) Assignee: Black & Decker Inc., Newark, DE (US)

( * ) Notice: Subject to any disclaimer, the term of this patent is extended or adjusted under 35 U.S.C. 154(b) by 901 days.

(21) Appl. No.: 10/877,078

(22) Filed: Jun. 25, 2004

(65) Prior Publication Data

US 2005/0028317 A1 Feb. 10, 2005

(30) Foreign Application Priority Data

Jun. 26, 2003 (GB) ..... 0314932.5

(51) Int. Cl.
*A47L 9/00* (2006.01)

(52) U.S. Cl. ..... 15/323; 15/414; 15/327.1

(58) Field of Classification Search ..... 15/323, 15/414, 327.1, 337, 339
See application file for complete search history.

(56) References Cited

U.S. PATENT DOCUMENTS

| | | | | |
|---|---|---|---|---|
| 3,872,538 | A * | 3/1975 | Crouser | 15/323 |
| 6,058,558 | A * | 5/2000 | Kim | 15/323 |
| 6,345,407 | B1 * | 2/2002 | Jupp | 15/323 |
| 6,367,118 | B1 * | 4/2002 | Berfield | 15/323 |
| 6,615,442 | B2 * | 9/2003 | Yang | 15/323 |
| 2005/0028317 | A1 * | 2/2005 | Barker et al. | 15/323 |
| 2007/0226944 | A1 * | 10/2007 | White | 15/323 |

FOREIGN PATENT DOCUMENTS

| | | | |
|---|---|---|---|
| DE | 8809157 | U | 11/1989 |
| EP | 0 747 000 | A1 | 11/1996 |
| EP | 1219221 | A | 7/2002 |
| GB | 2128075 | A | 4/1984 |
| GB | 2 344 991 | A | 6/2000 |
| GB | 2 345 841 | A | 7/2000 |
| WO | WO 99/49771 | A1 | 10/1999 |

* cited by examiner

*Primary Examiner*—Lee D Wilson
(74) *Attorney, Agent, or Firm*—John Yun; Bruce S. Shapiro; Wesley Muller

(57) ABSTRACT

A mounting device 202 for mounting accessories 258, 260 of a vacuum cleaner to an elongate tube 94 of the vacuum cleaner for storage is disclosed. The device 202 comprises a collar 244 for mounting to the elongate tube 94 and a body portion 256 has open ends for accommodating accessories 258, 260 for storage. The device 202 also includes a latching portion 204 for releasably mounting the device to a housing of the vacuum cleaner.

4 Claims, 15 Drawing Sheets

MOUNTING DEVICE FOR VACUUM CLEANER ACCESSORY

In conventional cylinder type vacuum cleaners, a motor arranged in a housing of the vacuum cleaner drives a fan, which causes air to be displaced radially outwards of the fan and expelled through vents in the housing. This in turn causes suction upstream of the fan, which draws dirty air into the vacuum cleaner housing, through a suitable filter such as a rigid filter unit or a flexible filter bag, the filter being located between an inlet of the housing and the fan. As a result, dirty air is drawn along a suitable accessory such as a flexible hose connected to the housing inlet, enters the inlet and passes through the filter, and cleaner air passes through the fan and is expelled through the vents in the housing.

Cylinder type vacuum cleaners are usually provided with a range of removable accessories, such as a floor cleaning brush or a nozzle which are mountable to an elongate tube connected to the flexible hose of the vacuum cleaner. It is known to store such accessories on the vacuum cleaner so that they do not become lost. For example, it is known to store accessories on a handle portion of the vacuum cleaner.

According to the present invention, there is provided a mounting device for mounting at least one accessory of a vacuum cleaner to an elongate tube of the vacuum cleaner for storage of the or each said accessory, the device comprising:

- a body portion adapted to be mounted to the elongate tube of the vacuum cleaner;
- at least one support portion for supporting a respective accessory for storage thereof on the vacuum cleaner; and
- at least one mounting extending from said body portion for releasably mounting the device to a housing of the vacuum cleaner.

By providing a device which is mounted to an elongate tube of the vacuum cleaner and has at least one support portion for supporting a respective accessory and at least one mounting portion for mounting the device to a housing of the vacuum cleaner, this provides the advantage that a single component is provided which simultaneously performs the function of mounting accessories to the elongate tube for storage and mounting the elongate tube to the housing. This enables the cost of manufacturing a vacuum cleaner incorporating the device to be minimised. Furthermore, by mounting the device to the elongate tube, this provides the advantage of enabling accessories to be mounted to a part of the vacuum cleaner not normally engaged by the user's hands when in use, thus minimising the risk that the device should become obstructive during use of the vacuum cleaner.

The body portion may comprise a first part adapted to be mounted to the elongate tube and a second part including the or each said support portion, wherein said second part is adapted to me removably mounted to said first part.

By providing a second part adapted to be removably mounted to a first part, this provides the simultaneous advantages of enabling the device to me more easily injection moulded, thus reducing the cost of manufacture of the device, and enabling the second part to be removed during use of the vacuum cleaner, thus minimising the risk of the device causing an obstruction or inconvenience to the user of the vacuum cleaner.

The device may further comprise first engaging means on one of said first and second parts, and second engaging means on the other of said first and second parts, for removable engaging said first engaging means.

In a preferred embodiment, the first part comprises at least one split annular member and at least one groove at a split portion of a respective said annular member, and the second part comprises at least one first projection for engaging a respective said groove.

This provides the advantage that the split portion of at least one said annular member simultaneously performs the functions of enabling the first portion to be mounted to the elongate tube and forming a stop for correctly positioning the second part relative to the first part. This in turn enables the cost of manufacture of the device to be minimised.

The first engaging means may comprise at least one slot on one of said first and second parts adapted to engage a respective second projection on the other of said first and second parts.

At least one said slot may have a closed end for limiting sliding movement of the slot relative to the corresponding said second projection.

This provides the advantage of assisting in correctly positioning the second part relative to the first part, while also reducing the risk of the second part becoming accidentally detached from the first part.

In a preferred embodiment, the second part comprises an elongate body member and at least one said support portion is located adjacent a respective end of the body member.

This provides the advantage of enabling the body member, and possibly also the accessories, to extend generally in the same direction as the longitudinal axis of the elongate tube, thus more efficiently utilising storage space on the vacuum cleaner.

The or each slot may be provided on the second part and the or each second projection may be provided on the first part.

This provides the advantage of enabling the second part to be mounted to the first part from either direction, enabling convenient left or right-handed use of the device.

At least one said mounting portion may comprise a respective hollow third projection for engaging a corresponding recess in the housing of the vacuum cleaner.

This provides the advantage of enabling the mounting portion to be injection moulded while having as much mechanical strength as possible.

A preferred embodiment of the invention will now be described, by way of example only and not in any limitative sense, with reference to the accompanying drawings, in which.

Figure 1:
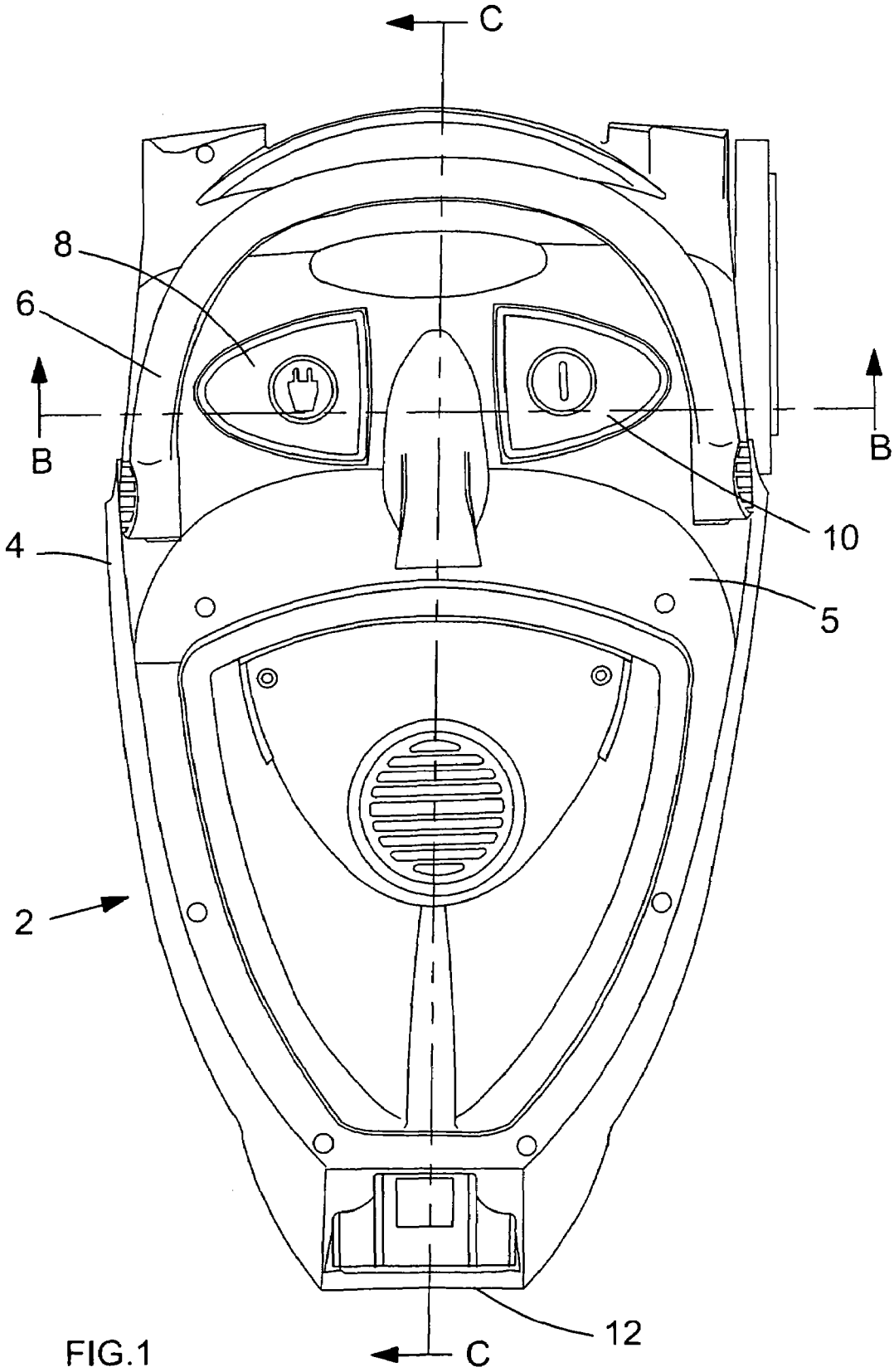
FIG. 1 is a plan view of a vacuum cleaner embodying the present invention.
Figure 2:
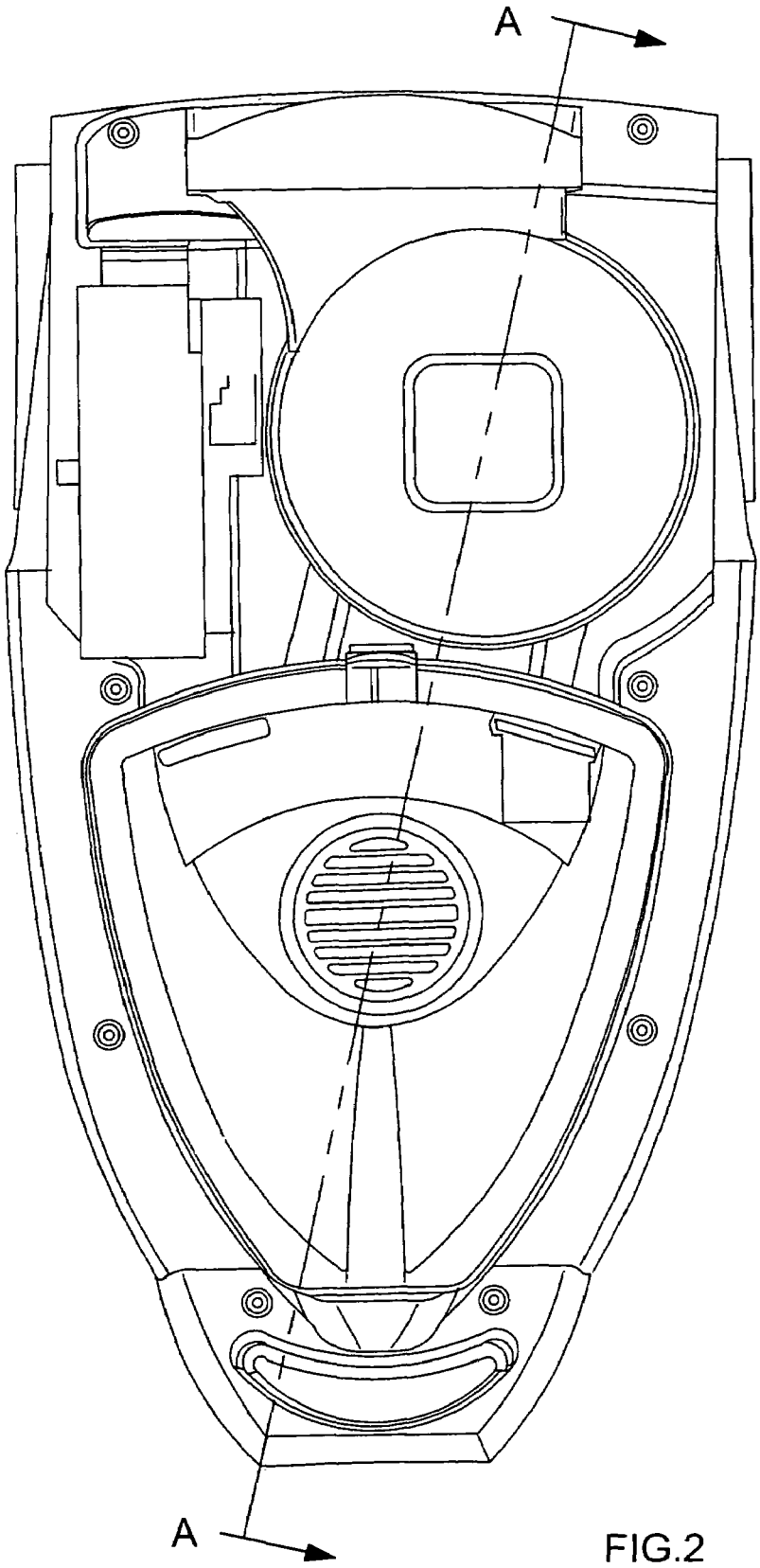
FIG. 2 is a partially cut away plan view of the vacuum cleaner housing of FIG. 1.

Referring to FIGS. 1 to 4, a cylinder type vacuum cleaner 2 has a housing 4 having a main housing part 5, a carrying handle 6 and wheels 7. A cable winder switch 8 and ON/OFF switch 10 are provided on an upper part of the housing.

The housing 4 defines an inlet 12 for connection to a flexible hose 14 (FIG. 12) at one end of the housing. A dirt collection receptacle 16 is removably attached to the housing 4 by means of a suitable latching mechanism (not shown) and defines a dirt collection chamber 18. The receptacle 16 has a central raised portion 20 for sealing engagement with a cylindrical filter element 22 formed from pleated fibrous material, such as paper or textile, covered by a breathable fabric, and is closed by a lid 24 which sealingly engages upper part 26 of filter element 22 by means of an annular seal 28, the annular seal surrounding a vent 30 in the lid 24, the function of which will be described in greater detail below. The lid 24 also has an edge 32 for gripping by a user during lifting of the lid.

The dirt collection unit 16 is held in position by the latching mechanism against an inner wall 34 of a recess integrally formed with the main part 5 of the housing 4. The raised portion 20 of the dirt collection unit 16 has a central aperture 36 cooperating with an aperture in upper wall 34 of recess 36, the raised portion 20 being surrounded by first 40 and second 42 trough regions for collecting dirt, in a manner which will be described in greater detail below.

A motor chamber 44 communicates with recess 36 via an aperture 46, and a motor 48 is mounted via sealing mounts 50 for rotation about an axis 52. A fan (not shown) is mounted coaxially with motor 48 and communicates via exhaust outlet 54 with the atmosphere. A filter cassette (not shown) containing a hepa filter is mounted in outlet 54 for filtering air expelled out of the outlet 54 by means of the fan.

The recess 36 is closed by means of closure plate 56, which is mounted to the main housing part 4, and is provided with a bypass valve 58 for allowing entry of air into recess 36 if the air pressure within recess 36 falls below a predetermined value. In this way, the main housing part 4 can be easily injection moulded, the inner wall 34 forming a recessed part of the main housing part 4. The recess 36 is then closed by means of closure plate 56 so that the recess 36 defines a duct between the outlet 38 of filter unit 22 and an inlet of the motor chamber 44.

The operation of the vacuum cleaner 2 will now be described.

Figure 3:
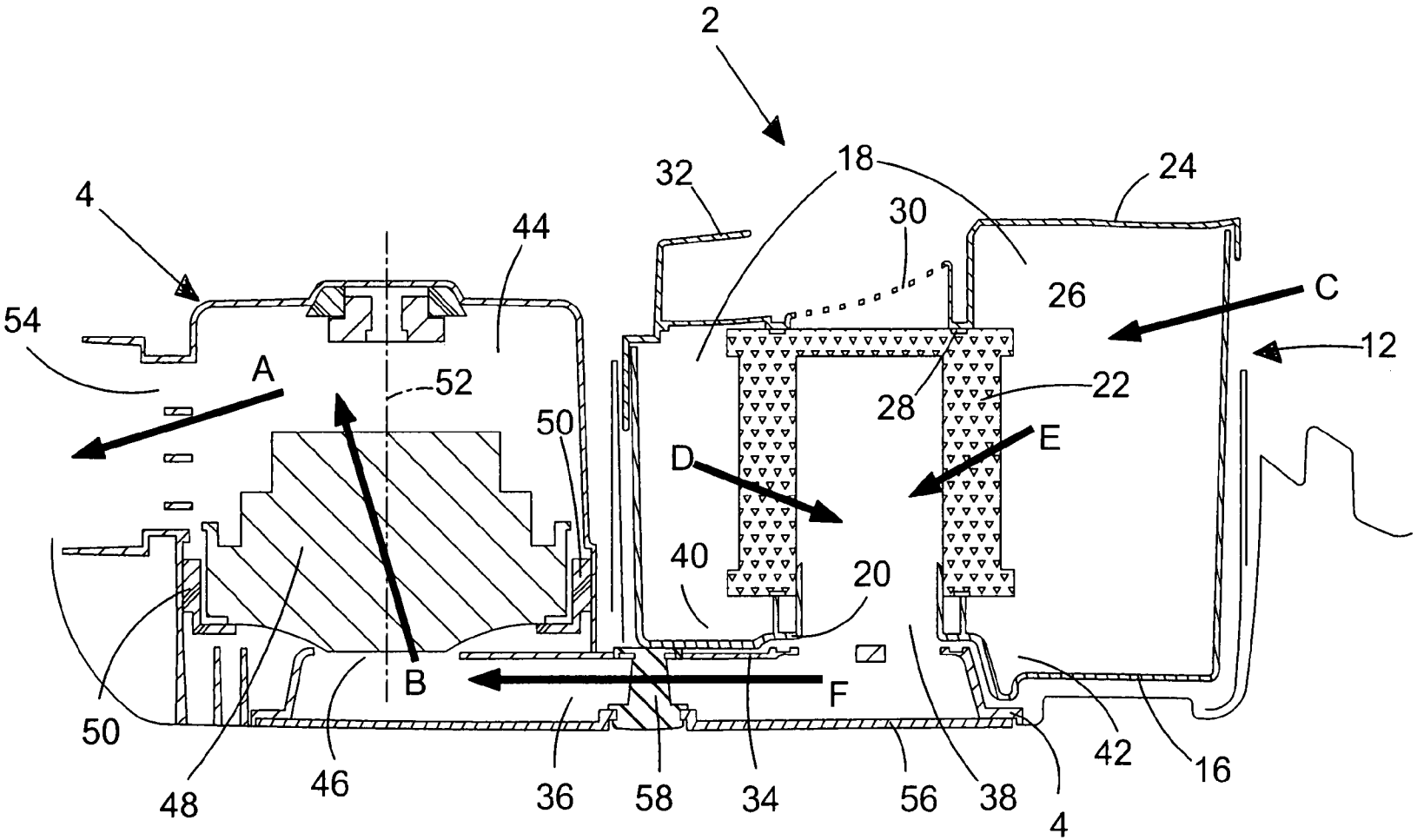
FIG. 3 is a view along the line A-A in FIG. 2.
Figure 4:
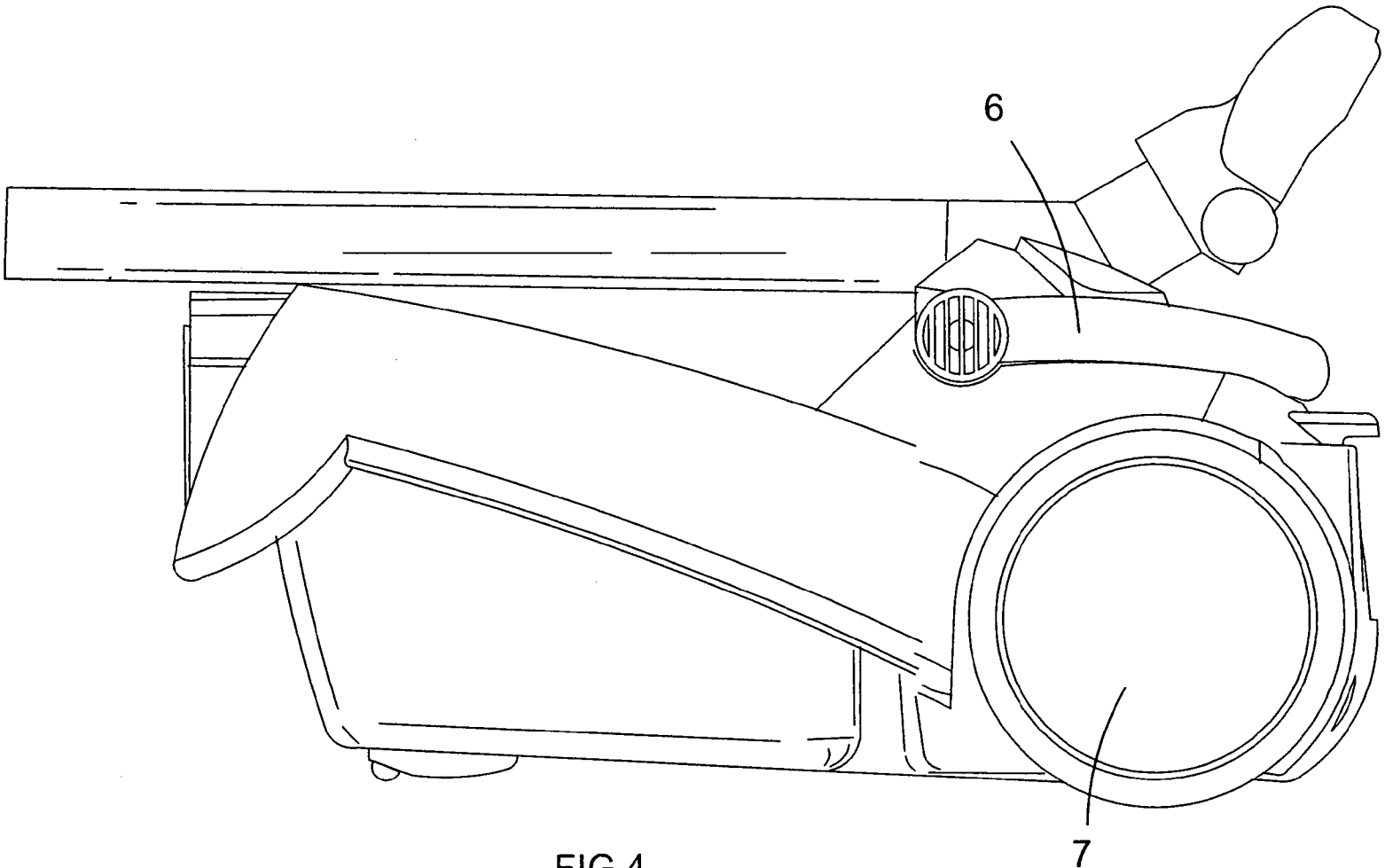
FIG. 4 is a side view of the vacuum cleaner of FIG. 1.

Actuation of motor 46 by means of ON/OFF switch 10 causes the fan to radially displace air out of outlets 54 in the direction of arrow A shown in FIG. 3. As a result, suction is caused upstream of the fan, which draws air from recess 36 generally axially into motor chamber 44 in the direction of arrow B. This in turn causes dirty air to be drawn through inlet 12 (to which a suitable accessory such as a floor cleaning head (FIG. 5) is connected by means of a flexible hose (FIG. 12)), and is drawn into dirt collection chamber 18 in the direction of arrow C and then inwardly through the walls of filter unit 22 in the direction of arrows D and E. Because of annular seal 28 surrounding vent 30, the only source of air to the motor chamber 44 at negative pressure is via inlet 12.

Figure 8:
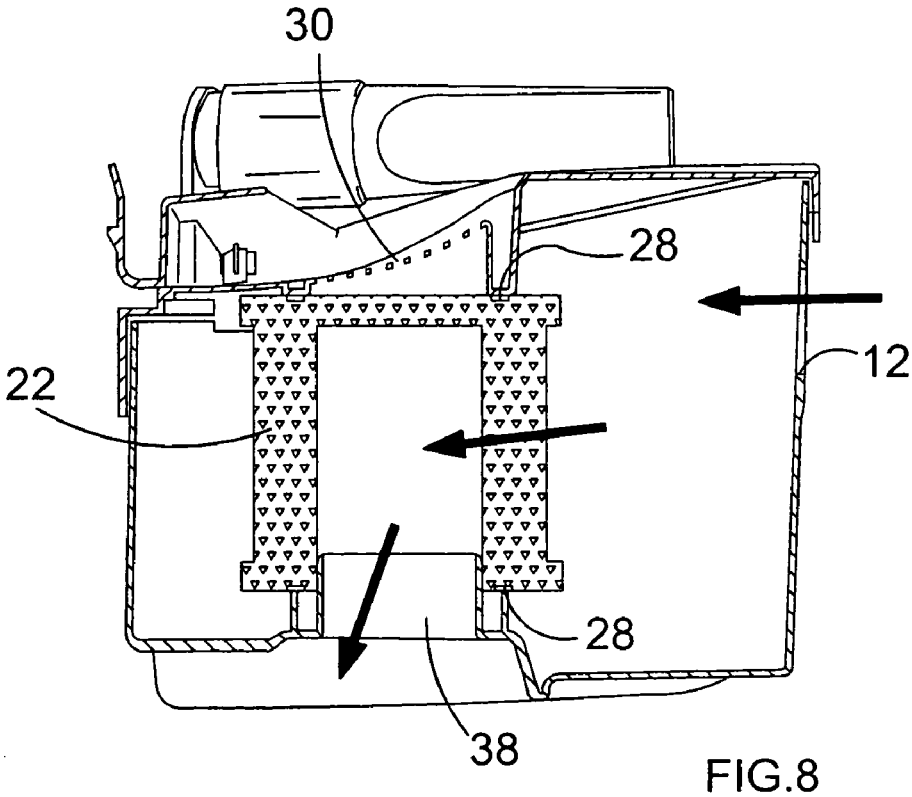
FIG. 8 is a sectional view along the line D-D in FIG. 7.

The air filtered by filter unit 22 then passes out of aperture 38 and along the duct defined by recess 36 in the direction of arrow F. If the inlet 12 should become blocked (for example as a result of an obstacle coming into contact with it) the resulting pressure difference between the interior of recess 36 and the atmosphere causes bypass valve 58 to allow air to enter the recess 36 to prevent motor 46 from overheating. The air path from the inlet 12 to the outlet 38 via the filter unit 22 is shown in more detail in FIG. 8.

Figure 10:
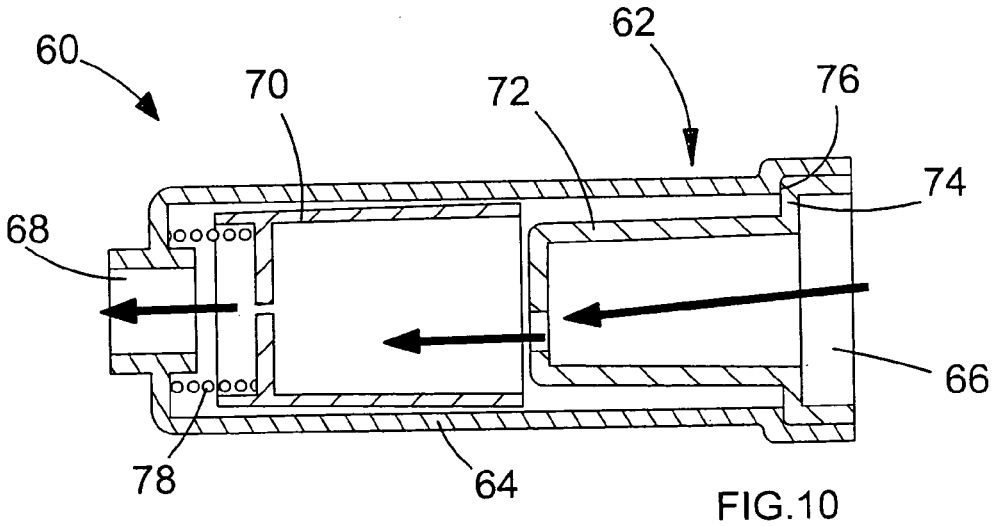
FIG. 10 is a cross-sectional view of a "filter full" indicator mechanism of the vacuum cleaner of FIG. 1.

Referring now to FIG. 10, a "filter full" indicator mechanism 60 is mounted to closure plate 56 in recess 36 at a part of the closure plate having a transparent window portion 62. The indicator mechanism 60 comprises a housing 64 having an opening 66 into which air enters from externally of the vacuum cleaner housing 4 by means of a suitable valve, which may be the by-pass valve shown in FIG. 3. The housing 64 has an outlet 68 open to the interior of recess 36, and is provided with a green perforated cover member 70 which can slide axially relative to a red perforated flag member 72, which has a flange 74 abutting a corresponding recess 76 in the housing 64. A cover member 70 is urged over the flag member 72 by means of a compression spring 78.

In normal operation of the vacuum cleaner (i.e. in the absence of blockages in the air flow path and with clean filters in the filter unit 22), the difference in air pressure between the outlet 68 and the inlet 66 is insufficient to displace the cover member 70 from the flag member 72 against the force of compression spring 78. However, as the filter unit 22 becomes blocked by dirt, the difference in pressure between the recess 36 and the atmosphere (and therefore between the outlet 68 and the inlet 66) increases, as a result of which the cover member 70 is displaced against the force of spring 78 from flag member 72, and the red coloured flag member 72 can then be seen via transparent portion 62, providing the user with a visual indication that the filter needs to be cleaned.

Figure 9:
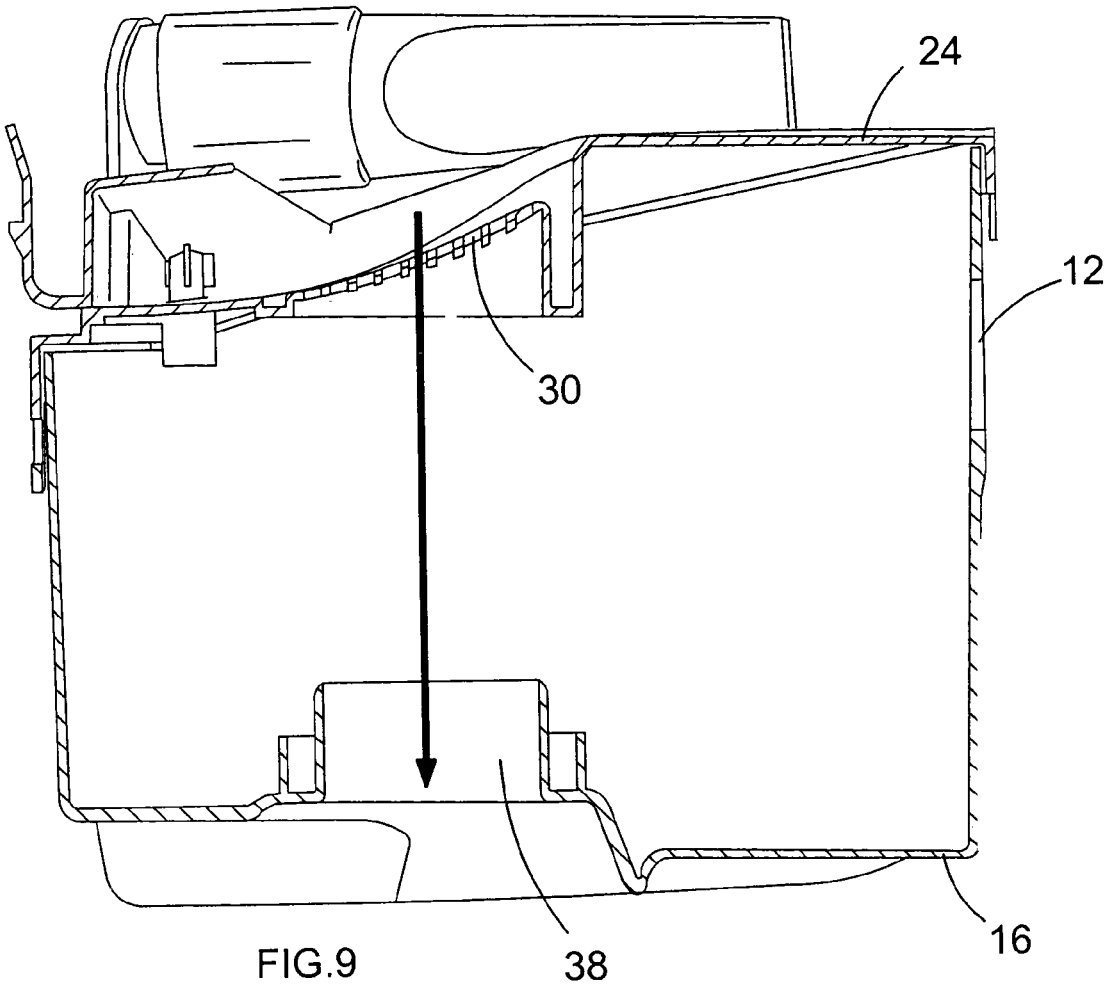
FIG. 9 is a sectional view, corresponding to FIG. 8, but with the filter element removed.

Referring back to FIG. 3, in order to clean the filter, the user lifts lid 24 by means of gripping portion 32, and then removes filter unit 22 and dirt collection chamber 16. Because the central portion of the dirt collection chamber 16 is raised, dirt trapped on the outer surface of filter unit 22 has a tendency to fall into trough regions 40, 42 and avoids falling into outlet 38. If the motor 46 should accidentally be actuated when the filter unit 22 is removed, the opening provided by opened lid 24 is nearer to outlet 38 than inlet 12, as a result of which relatively clean air from the atmosphere passes into recess 36 in preference to dirty air from the inlet 12, thus minimising the risk of the motor 46 being damaged by dirt. Even if the lid 24 should swing shut, relatively clean air passing through vent 30 still passes into duct 36 in preference to dirty air from inlet 12, in the absence of filter unit 22 blocking the path of air through the vent 30 by means of seal 28. This arrangement is shown in more detail in FIG. 9.

Figure 5:
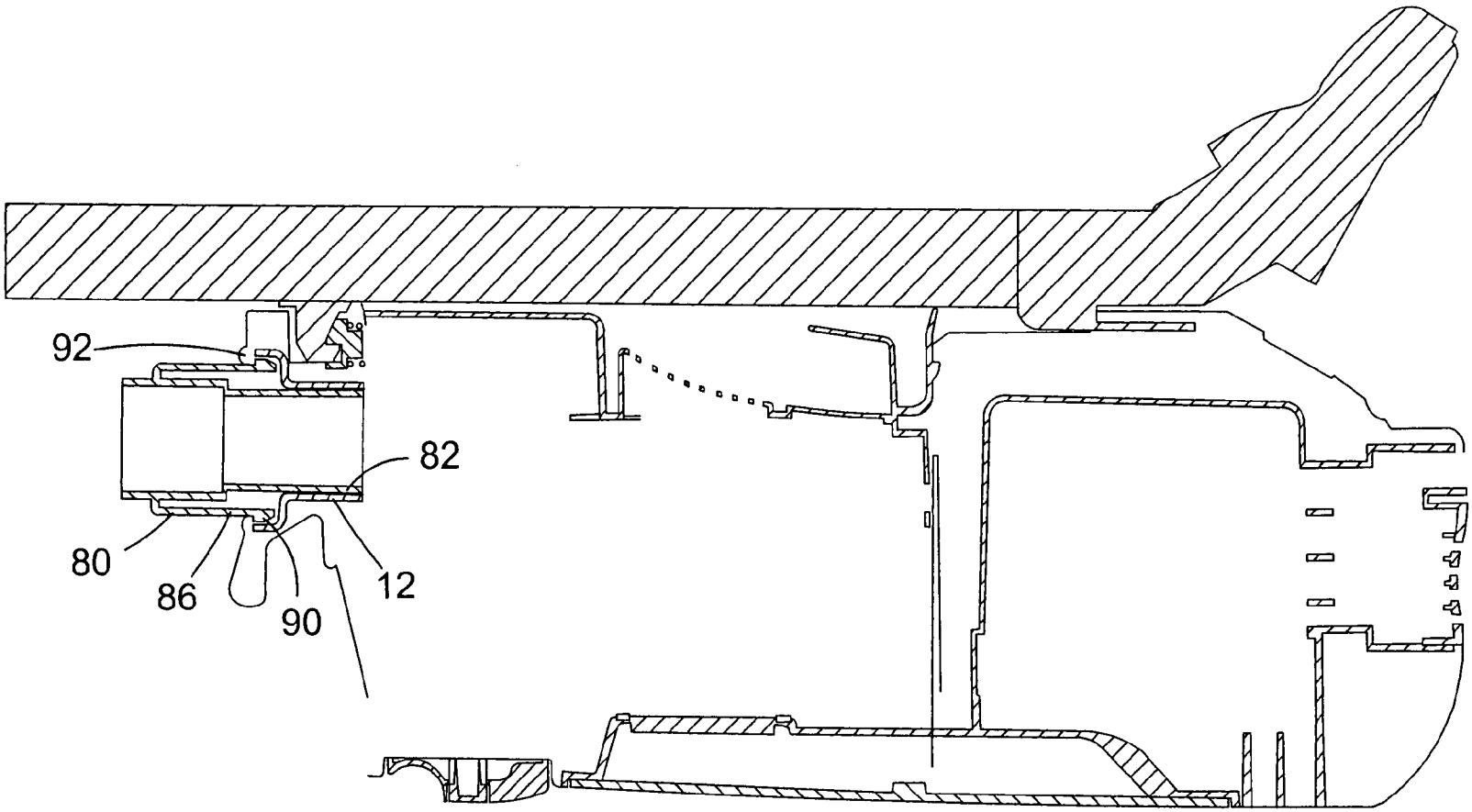
FIG. 5 is a sectional view along the line C-C in FIG. 1 with internal components of the vacuum cleaner removed.
Figure 6:
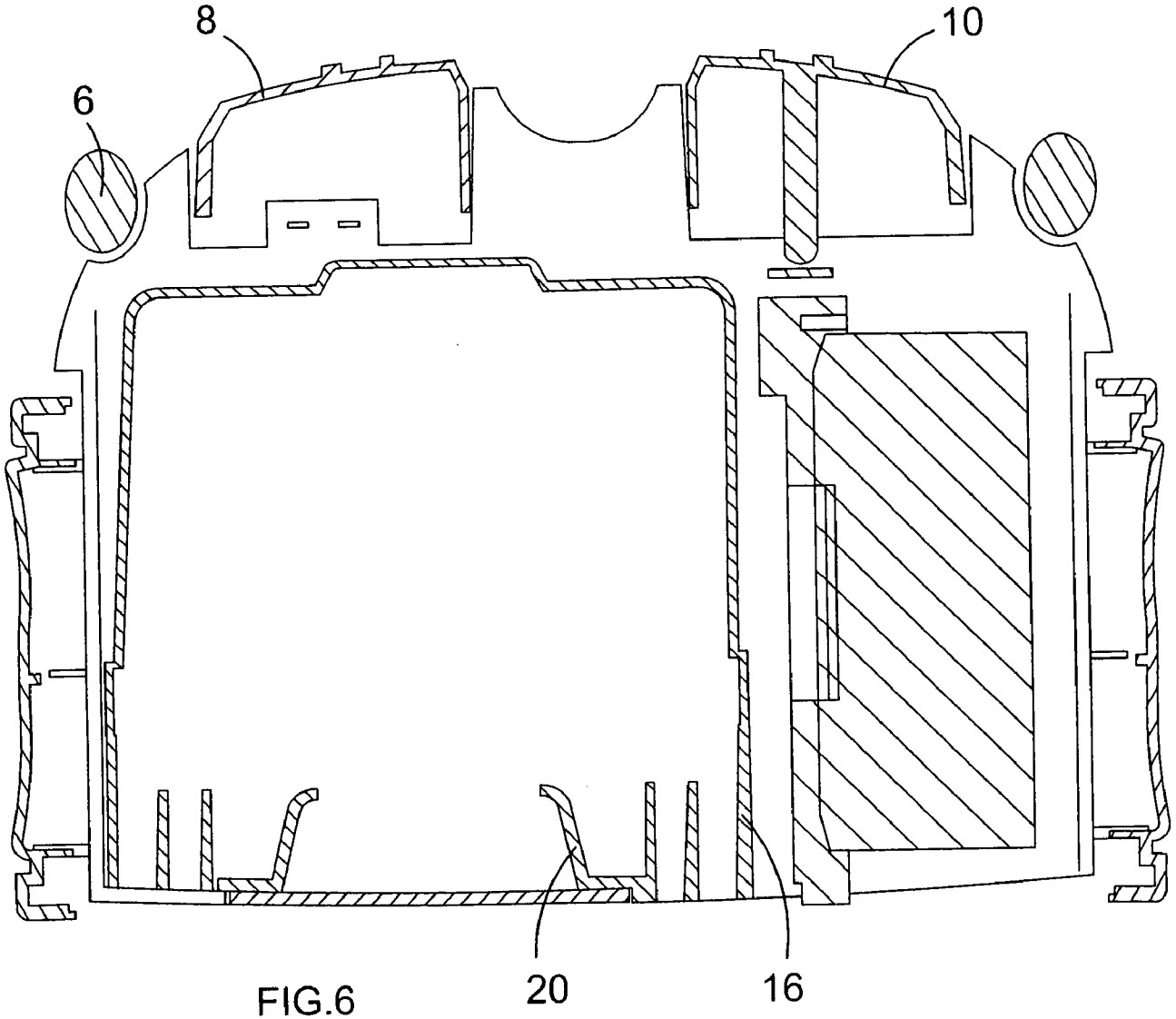
FIG. 6 is a sectional view along the line B-B in FIG. 1 with internal components of the vacuum cleaner removed.
Figure 7:
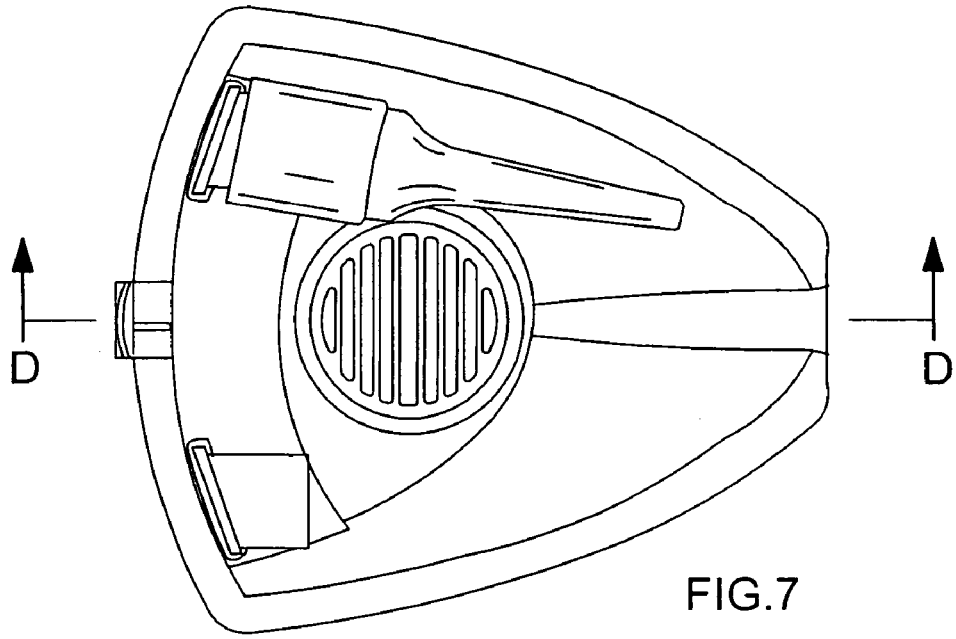
FIG. 7 is a plan view of a removable dirt container lid of the vacuum cleaner of FIG. 1.
Figure 12:
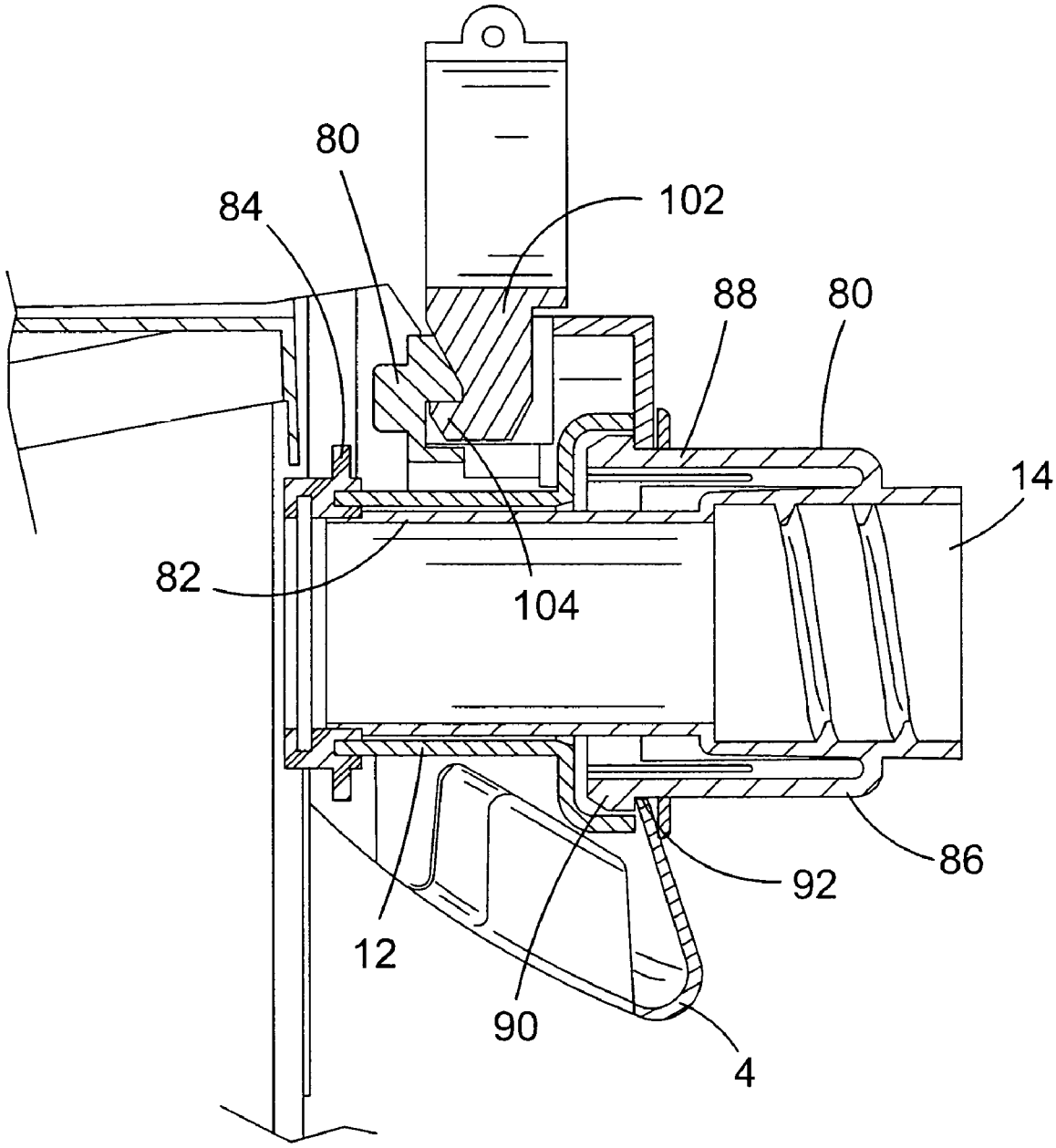
FIG. 12 is a cross-sectional view showing connection of a flexible hose to an inlet of the housing of the vacuum cleaner of FIG. 1.

Referring now to FIGS. 5 and 12, the flexible hose 14 is connected to housing inlet 12 by means of a hose connection moulding 80 having a radially inner part 82 which cooperates with a rubber seal 84 (which also forms a seal with dirt collection chamber 16) and a radially outer part 86 which is provided with resilient fingers 88 having heads 90, which locate behind edge portions 92 of the main housing part 4 to hold the connector 80 in position. In order to release the connector 80 from the housing 4, the resilient fingers 88 are pushed radially inwards until the heads 90 are released from the corresponding edge parts 92, so that the connector 80 can be axially withdrawn from the inlet 12.

Figure 11:
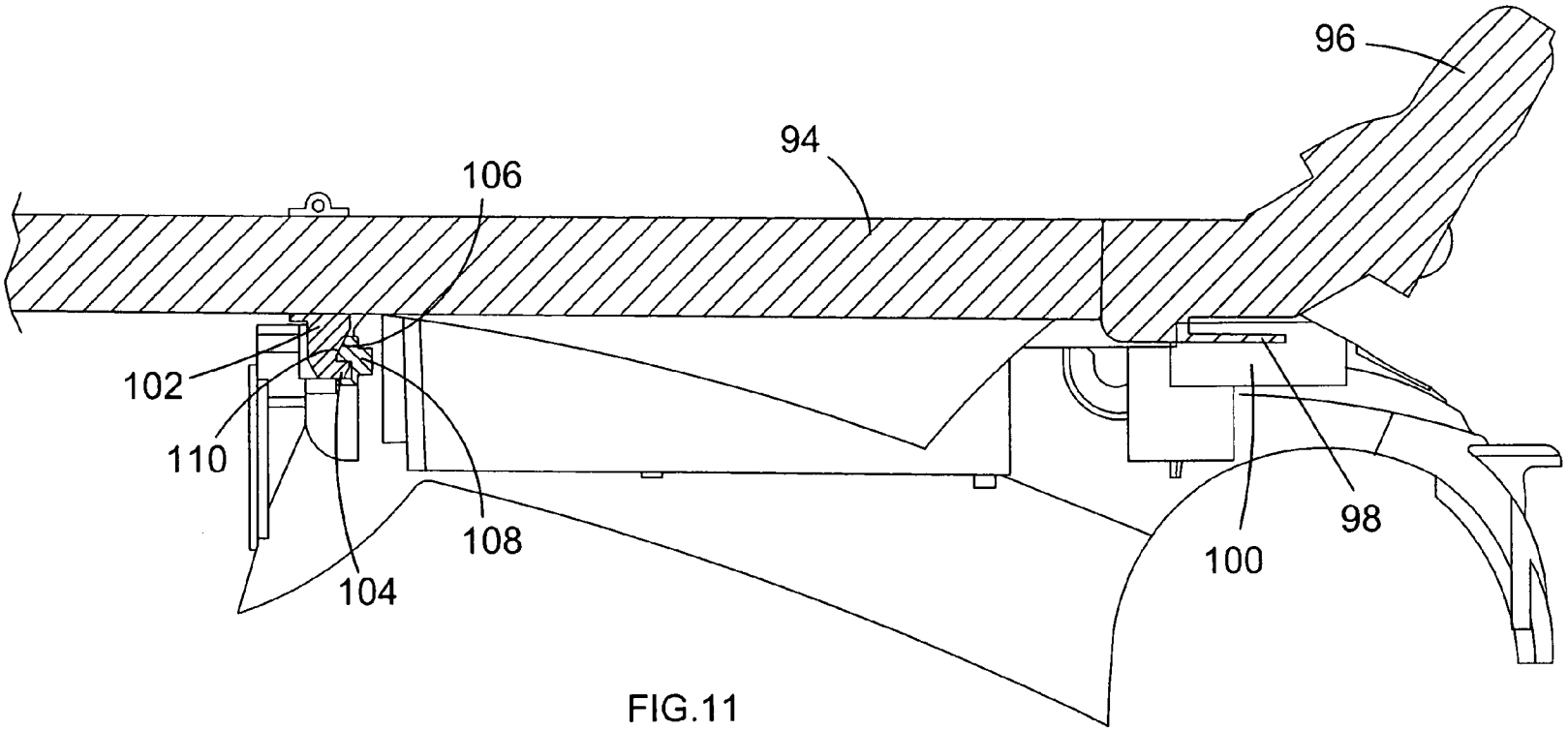
FIG. 11 is a sectional view of part of the housing of the vacuum cleaner of FIG. 1, with a floor-cleaning accessory mounted to the housing.

FIGS. 11 and 12 show a rigid tube 94 carrying a floor cleaning head 96 removably mounted to the housing 4 for storage by locating an elongate projection 98 provided on cleaning head 96 in a corresponding recess 100 on housing 4. A collar 102 surrounding tube 94 has a latching portion 104 and an inclined surface 106, and cooperates with a spring loaded latching portion 108 on housing 4 having corresponding inclined surface 110. Movement of the upper part of the tube 94 shown in FIG. 11 in the direction of arrow G causes mutual engagement of latching portion 104 and inclined surface 110, as a result of which latching portion 108 is displaced against the action of a spring (not shown) to cause latching portion 104 to be latched in position behind latching member 108 with inclined surfaces 106, 110 in contact with each other. In order to release the tube 94 from the housing 4, a release catch (not shown) is depressed to displace latching member 108 against the action of the spring so that the latching portion 104 of collar 102 can be withdrawn from the housing.

Figure 19:
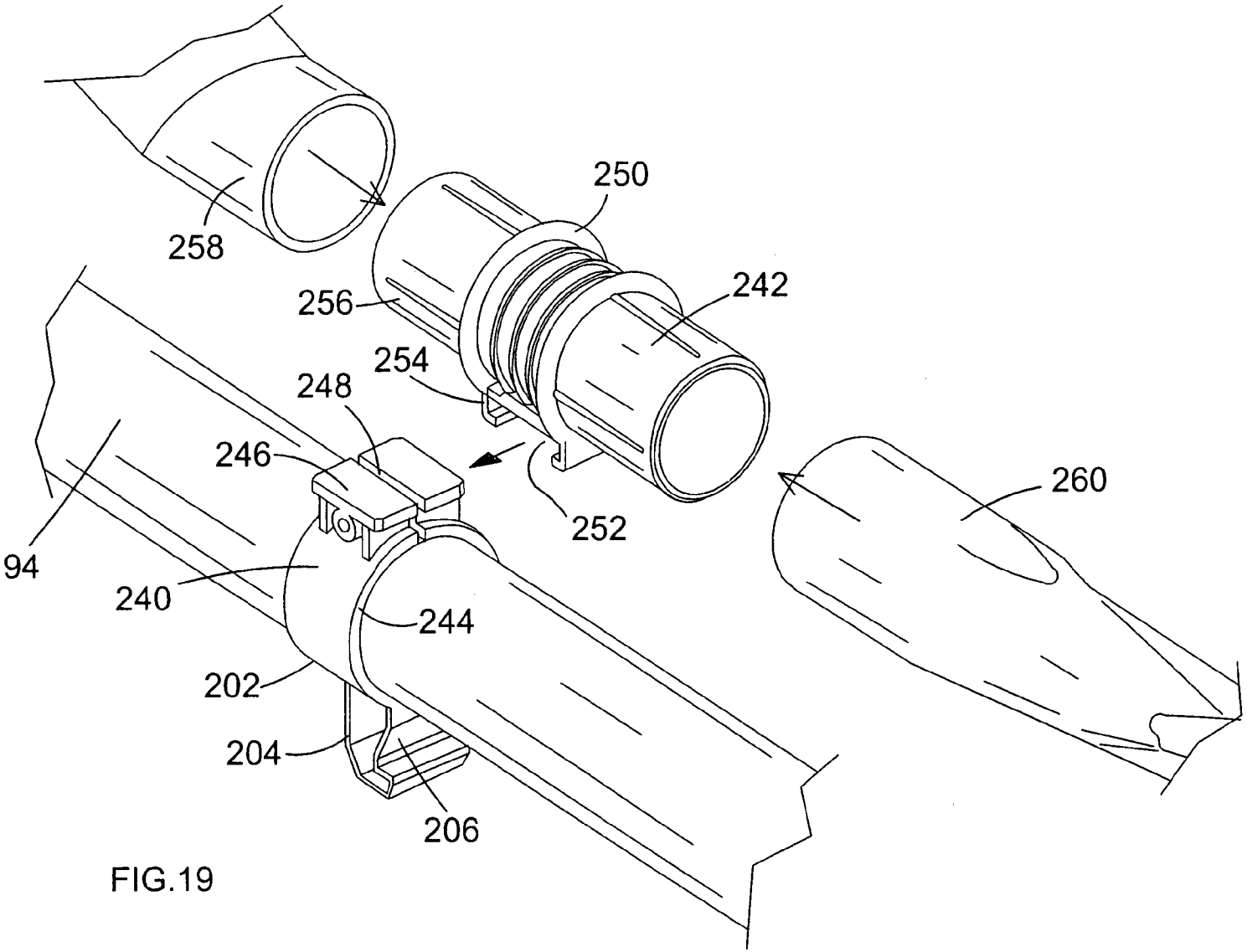
FIG. 19 is a perspective view of a device for mounting accessories to the vacuum cleaner for storage.

FIG. 19 shows a further embodiment of collar 202 for mounting to the rigid tube 94 and mounting the rigid tube 94 to the housing 4. Parts common to the embodiment of FIGS. 11 and 12 are denoted by like reference numerals but increased by 100.

The collar 202 is formed as two separate parts, a first part 240 formed as an injection moulded split ring and a tubular second part 242 which is removably attachable to the first part 240. The first part 240 has a tubular section 244 which is placed around the tube 94 and is formed on one side with latching portion 204 having inclined surface 206. The latching portion is formed as a hollow component to enable the first part 240 to be injection moulded while having sufficient strength. The first part 240 is also provided with a generally rectangular projection 246 divided by a groove 248 at the split part of tubular section 244, the projection 246 being arranged opposite the latching portion 204.

The second part 242 has an annular collar 250 having a slot 252 having an open end 254 and a closed end (not shown) for receiving the rectangular projection 246 on first part 240. The collar 250 surrounds a tubular body portion 256 having open ends for receiving an accessory 258, 260 at each end in an interference fit. The slot 252 can be mounted to the projection 246 from either direction, thus permitting left and right handed use of the collar 202, and the second part 242 is correctly located on the first part 240 by means of the closed end (not shown) of slot 252 and engagement of a projection (not shown) in slot 252 with groove 248 in projection 246. The orientation of the slot 252 relative to the body portion 256 is such that the body portion 256 and the accessories 258, 260 extend generally parallel to the longitudinal axis of tube 94. In this way, space can be particularly efficiently used for storing accessories 258, 260 on tube 94. Furthermore, by providing a collar 202 which serves the dual functions of mounting accessories 258, 260 to tube 94, and mounting tube 94 to the housing by means of latching portion 204, only a single component need by constructed, which reduces the cost of manufacturing the vacuum cleaner incorporating collar 202.

Figure 13:
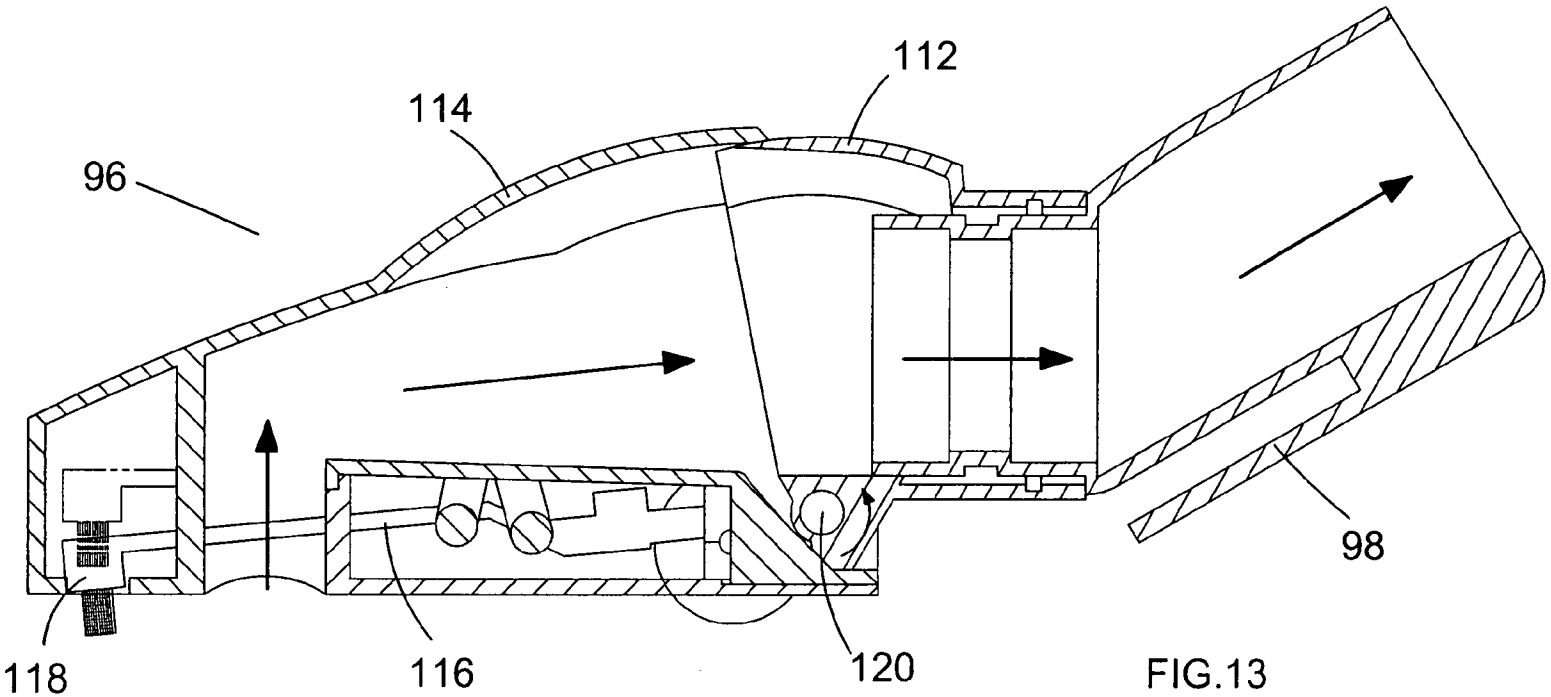
FIG. 13 is a cross-sectional view of a cleaning head of the floor-cleaning accessory of FIG. 11 with a rigid tube connected thereto in a lowered position.
Figure 14:
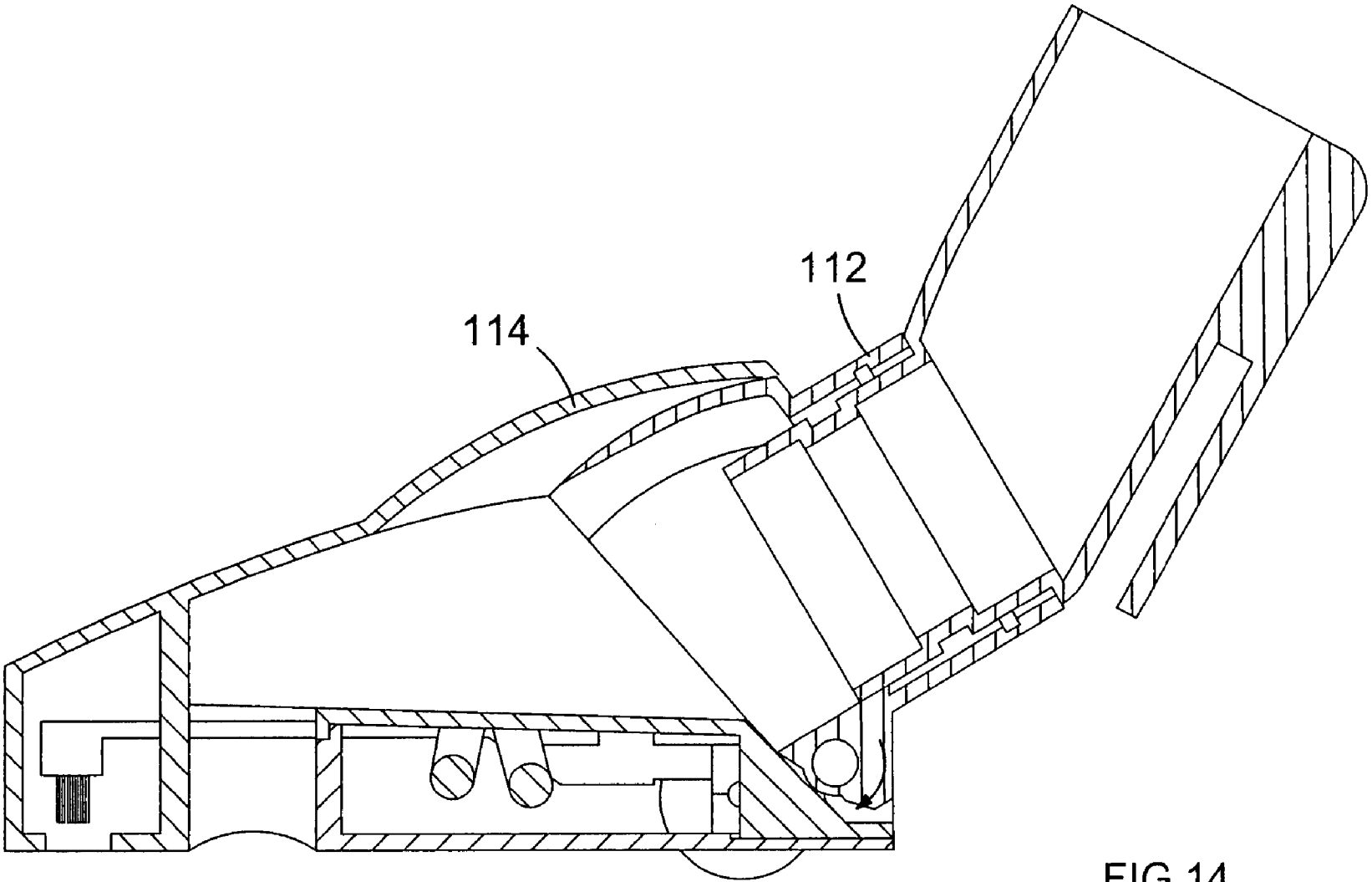
FIG. 14 is a sectional view, corresponding to FIG. 13, of the cleaning head of FIG. 13 with the rigid tube connected thereto in a raised position.
Figure 15:
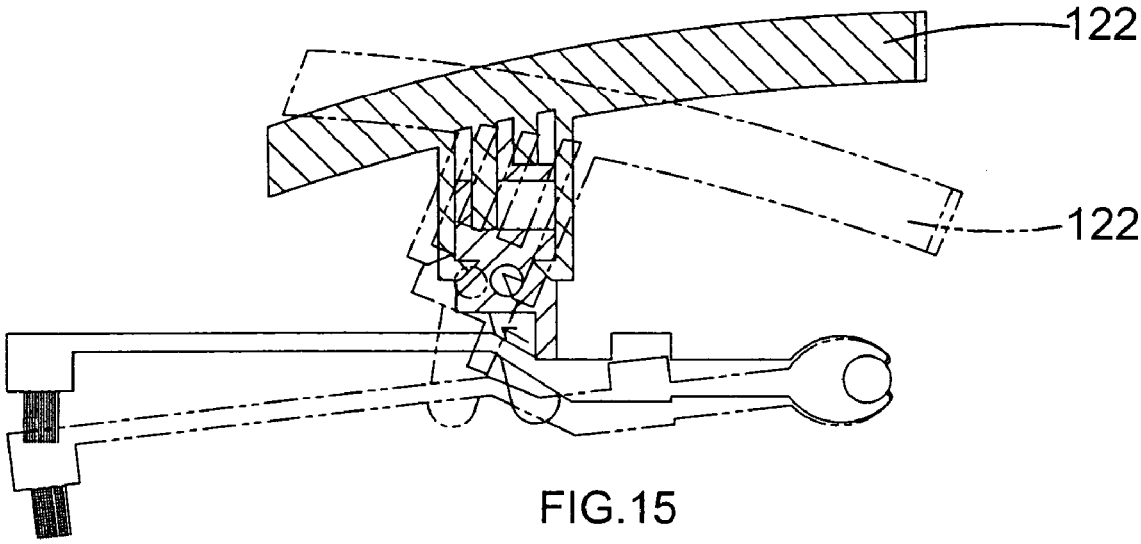
FIG. 15 is a schematic illustration of the operation of a mechanism for moving a brush plate between "brush up" and "brush down" positions in the cleaning head of FIG. 13.
Figure 18:
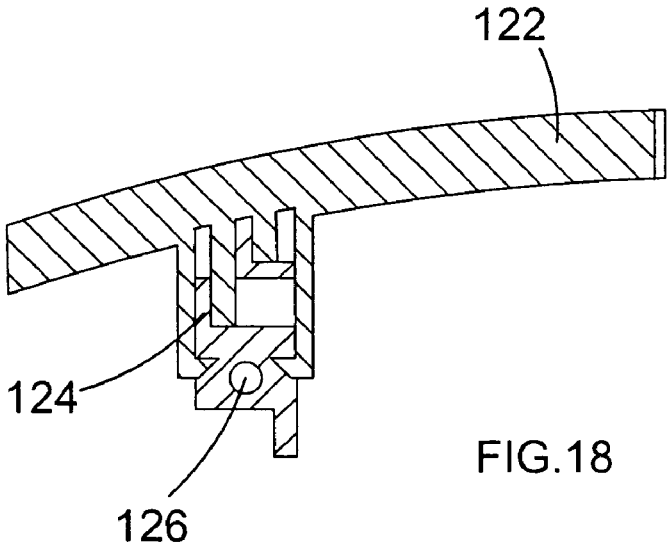
FIG. 18 is a schematic side cross-sectional view of the actuator mechanism of FIGS. 15 to 17.
Figure 16:
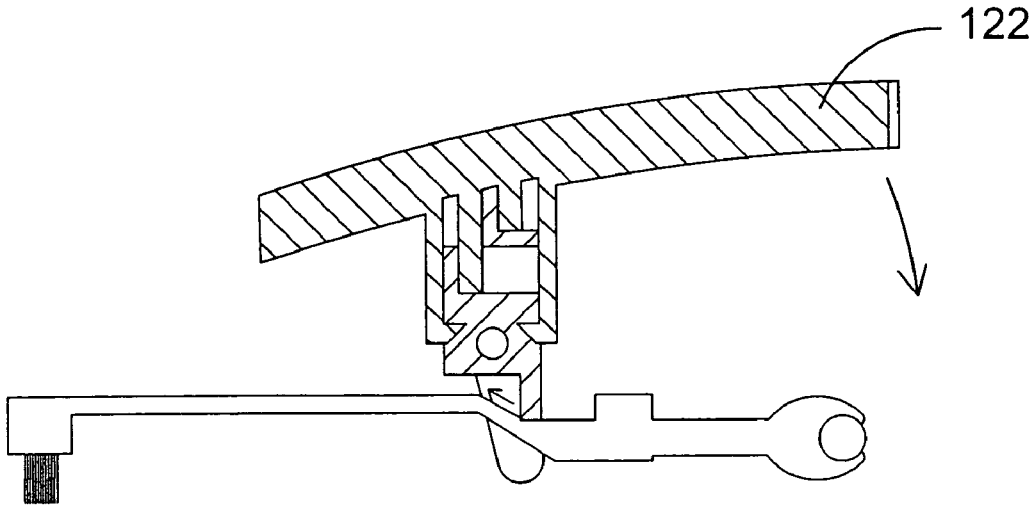
FIG. 16 is a schematic side view, corresponding to FIG. 15, of the brush plate and actuator mechanism in the "brush up" position.
Figure 17:
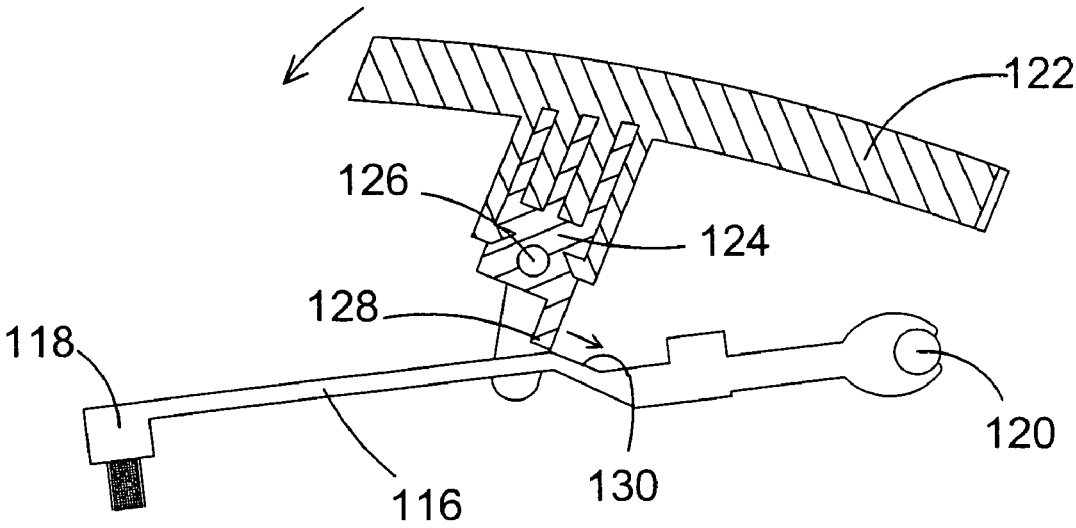
FIG. 17 is a schematic side view showing the brush plate and actuator mechanism in the "brush down" position.

FIGS. 13 to 18 show in more detail the floor cleaning head 96 shown in FIG. 11. The cleaning head 96 has a connector portion 112 pivotally mounted to a head portion 114, so that the angle of the connector portion 112 relative to the head portion 114 can be adjusted, as shown in FIGS. 13 and 14.

A brush plate 116 carries a brush member 118 and is connected to a pivot 120 located at the rear of the head portion 114. The position of the brush member 118 relative to the head portion 114 is adjusted by means of a lever 122 (FIGS. 15 to 18). carrying actuator member 124 which pivots about axis 126 to move a projection 128 on actuator member 124 along an inclined surface 130 of brush plate 116. This causes pivotal movement of brush plate 116 about pivot 120 to move the brush member 118 between "brush up" and "brush down" positions. The brush plate 116 is urged into the "brush up" and "brush down" positions by means of suitable springs (not shown).

It will be appreciated by persons skilled in the art that the above embodiment has been described by way of example only, and not in any limitative sense, and that various alterations and modifications are possible without departure from the scope of the invention as defined by the appended claims. For example, the body portion 256 of FIG. 19 may extend generally at right angles to the longitudinal axis of tube 94.

The invention claimed is:

1. A mounting device for mounting an accessory of a vacuum cleaner to an elongate tube of the vacuum cleaner for storage of the accessory, the device comprising:

a body portion mountable to the elongate tube of the vacuum cleaner;

a support portion for supporting the accessory for storage on the vacuum cleaner;

a latch portion extending from said body portion for releasably mounting the body portion to a housing of the vacuum cleaner; and a first engaging member on one of said body portion or support portion, and a second engaging member on the other of said body portion or support portion for removable engagement with said first engaging member to couple said body portion to said support portion.

2. A mounting device for mounting accessory of a vacuum cleaner to an elongate tube of the vacuum cleaner for storage of the accessory, the device comprising:

a body portion mountable to the elongate tube of the vacuum cleaner;

a support portion for supporting the accessory for storage on the vacuum cleaner, a latch portion extending from said body portion for releasably mounting the body portion to a housing of the vacuum cleaner;

wherein the body portion comprises a split annular member that is secured to the elongate tube and having a projection extending therefrom, the support portion having a slot for engaging the projection to releasably secure the support portion to the body portion.

3. The device according to claim 1, wherein the first engaging member is a slot that engages a projection on the second engaging member.

4. The device according to claim 3, wherein said slot has a closed end for limiting the sliding movement of the slot relative to the projection.

* * * * *